US006381762B1

(12) United States Patent
Moser

(10) Patent No.: US 6,381,762 B1
(45) Date of Patent: May 7, 2002

(54) QUICK RELEASE TOILET SEAT HINGE ASSEMBLY

(76) Inventor: Scott A. Moser, 800 Silverado St., Suite 324, La Jolla, CA (US) 92037

( * ) Notice: Subject to any disclaimer, the term of this patent is extended or adjusted under 35 U.S.C. 154(b) by 0 days.

(21) Appl. No.: 09/808,362

(22) Filed: Mar. 15, 2001

(51) Int. Cl.[7] ..... A47K 13/12

(52) U.S. Cl. ..... 4/240; 4/236; 16/252; 16/254

(58) Field of Search ..... 4/240, 241, 236, 4/237, 234; 16/233, 252, 254, 362, 382

(56) References Cited

U.S. PATENT DOCUMENTS

| | | | | | |
|---|---|---|---|---|---|
| 720,116 | A | * | 2/1903 | Cowan | 16/256 |
| 2,877,469 | A | * | 3/1959 | JOhnson | 4/241 |
| 3,557,393 | A | * | 1/1971 | Waldon | 4/236 |
| 3,568,221 | A | * | 3/1971 | Haldopoulos | 4/240 |
| 3,802,000 | A | | 4/1974 | Waldon | 4/236 |
| 4,087,884 | A | * | 5/1978 | Seiderman | 16/129 |
| 4,133,061 | A | | 1/1979 | Hurd | 4/236 |
| 4,159,548 | A | | 7/1979 | Hewson | 4/236 |
| 4,173,802 | A | * | 11/1979 | Wikstrom | 4/236 |
| 4,319,365 | A | | 3/1982 | Bemis et al. | 4/236 |
| 4,326,307 | A | | 4/1982 | Baillie et al. | 4/236 |
| 4,367,567 | A | | 1/1983 | Sendoykas | 16/263 |
| 4,965,889 | A | | 10/1990 | Tissot et al. | 4/234 |
| 5,175,891 | A | | 1/1993 | Oshima et al. | 4/236 |
| 5,414,875 | A | | 5/1995 | Kappl et al. | 4/236 |
| 5,515,552 | A | * | 5/1996 | Tolsma | 4/236 |
| 5,933,875 | A | | 8/1999 | Hulsebus et al. | 4/240 |
| 6,070,295 | A | | 6/2000 | Hulsebus | 16/254 |

FOREIGN PATENT DOCUMENTS

| | | | | |
|---|---|---|---|---|
| FR | 2612390 A3 | * | 9/1988 | 4/240 |
| GB | 658158 | * | 10/1951 | 4/240 |

* cited by examiner

*Primary Examiner*—Michael Powell Buiz
*Assistant Examiner*—Huyen Le
(74) *Attorney, Agent, or Firm*—Welsh & Flaxman LLC

(57) ABSTRACT

A quick release hinge assembly for a toilet seat is disclosed. The assembly including a pair of fasteners each having a flange for engaging a toilet bowl when attached thereto and a head spaced above the flange. An anchor plate having a pair of slots formed on the bottom side thereof which cooperate with the heads of the fasteners to secure the anchor plate to a toilet bowl. The anchor plate further including a resiliently biased latch formed in the top surface thereof which locks and unlocks the anchor plate from one of the fastener heads to permit the anchor plate to slide off of the fasteners and a pair of spaced hinge mounting supports extending from the anchor plate to which a toilet seat and lid can be pivotally coupled.

20 Claims, 6 Drawing Sheets

QUICK RELEASE TOILET SEAT HINGE ASSEMBLY

BACKGROUND OF THE INVENTION

1. Field of the Invention

The present invention relates to hinges used in releasably securing a toilet seat to a toilet bowl. More particularly, the present invention relates to an easier, faster and simpler quick release hinge assembly requiring no special tools for attaching or releasing a toilet seat to a toilet bowl.

2. Description of the Prior Art

A fixed axial hinge arrangement traditionally is used to couple a toilet seat and lid combination together. Bolts and nuts passing through holes in the back flange of the toilet bowl secure the combination to a toilet bowl.

The removal process for such a combination can be time consuming. Removal may require various tools and require the individual to deal with loose parts. In addition to dealing with many tools and parts during removal, the individual must often deal with the same tools and parts during reassembly.

For example, removal of a toilet bowl seat and lid for any reason requires the loosening and removal of the bolts and nuts. Access to the bolts and nuts is normally in a cramped and "difficult to maneuver" area, thus making the installation and removal effort cumbersome and uncomfortable. This is particularly true for handicapped and/or medically infirmed persons (who may be less agile or lack the physical strength). All this leads to problems with lost parts, parts dropping in the toilet and difficulty in cleaning in, on and around the remaining parts.

Toilet seat attachment and removal arrangements currently exist which do not require the removal of traditional bolts or the use of tools. Representative of the prior art in this field are the following: U.S. Pat. No. 3,802,000 to Walden, U.S. Pat. No. 4,133,061 to Hurd, U.S. Pat. No. 4,159,548 to Hewson, U.S. Pat. No. 4,319,365 to Bemis et al., U.S. Pat. No. 4,326,307 to Baillie et al., U.S. Pat. No. 4,367,567 to Sendoykas, U.S. Pat. No. 4,965,889 to Tissot et al., U.S. Pat. No. 5,175,891 to Ohshima et al., U.S. Pat. No. 5,414,875 to Kappl et al., U.S. Pat. No. 5,933,875 to Hulsebus et al. and U.S. Pat. No. 6,070,295 to Hulsebus.

While each of these prior art devices attempts to solve the problems and challenges noted above, none of them provides a quick release slide off assembly merely requiring the lifting of a latch for operation. Those skilled in the art will understand the need for a toilet seat hinge assembly which is simple to install/remove, is composed of few moving parts and does not corrode. It is also desirable for the seat hinge assembly to provide for a smooth, sleek, and easily cleaned toilet bowl surface upon removal of the seat and/or lid. The present invention provides such a hinge assembly.

SUMMARY OF THE INVENTION

It is, therefore, an object of the present invention to provide a quick release hinge assembly for a toilet seat. The hinge assembly includes a pair of fasteners each having a flange for engaging a toilet bowl when attached thereto and a head spaced above the flange which engage an anchor plate having a pair of slots formed therein which cooperate with the pair of fasteners to secure the anchor plate to the fasteners. The anchor plate including at least one resiliently biased latch formed therein for locking and unlocking the anchor plate between the flange and head of each fastener. The anchor plate further including a pair of spaced hinge mounting supports extending therefrom to which a toilet seat and lid can be pivotally coupled.

It is a further objective of the present invention to provide an anchor plate which has an upper surface located above and covering the heads of said fasteners.

Still a further objective of the present invention is to provide an anchor plate with a resiliently biased latch formed in the upper surface of said anchor plate with a locking mechanism thereon which locks to the head of at least one of said fasteners.

Other objects and advantages of the present invention will become apparent from the following descriptions when viewed in conjunction with the accompanying drawings forming a part of the specification which sets forth a certain embodiment of the present invention.

DETAILED DESCRIPTION OF THE PREFERRED EMBODIMENT

Figure 1:
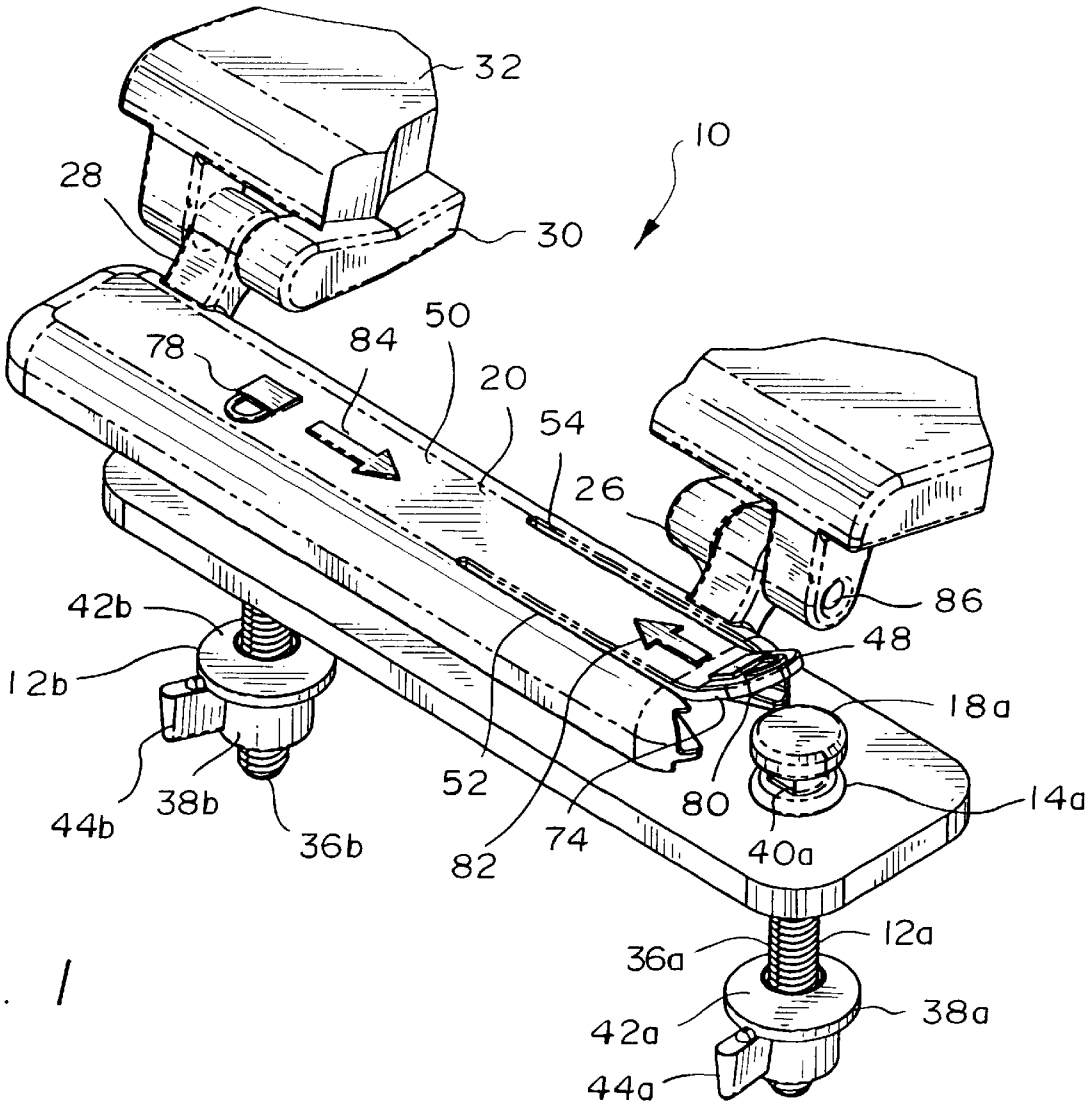
FIG. 1 is an exploded perspective view illustrating the quick release hinge assembly attaching to the top surface of the toilet bowl.

The detailed embodiment of the present invention is disclosed herein. It should be understood, however, that the disclosed embodiment(s) are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to FIGS. 1, 2, 6 and 7, a quick release hinge assembly 10 in accordance with the present invention is shown. The quick release hinge assembly 10 generally includes a pair of fasteners 12*a*, 12*b*. Each fastener 12*a*, 12*b* includes a flange 14*a*, 14*b* for engaging a toilet bowl 16 when attached thereto and a head 18*a*, 18*b* spaced above the flange 14*a*, 14*b*. The hinge assembly 10 also includes a one-piece anchor plate 20 having a pair of slots, or neck retaining sections, 22, 24 cooperating with the pair of fasteners 12*a*, 12*b* to secure the anchor plate 20 to the fasteners 12*a*, 12*b*. The hinge assembly 10 further includes at least one resiliently biased latch 22 formed in the anchor plate 20 for locking and unlocking the anchor plate 20 to at least one of the fasteners 12*a*, 12*b*. Finally, the anchor plate 20 includes a pair of spaced hinge mounting supports 26, 28 to which a toilet seat 30 and lid 32 are pivotally coupled.

The entire assembly, including fasteners, is preferably made of polypropylene. However, other resin-based materials or non-corroding metals may also be used without departing from the spirit of the present invention.

As shown in FIG. 1, the anchor plate 20 slides over the fasteners 12*a*, 12*b* to secure the hinge assembly 10 to a toilet bowl 16. In fact, and as will be discussed in greater detail below, a first bolt head 18*a* is about to be slidingly engaged at one end of the anchor plate 20, while the second bolt head 18*b* is positioned beneath the anchor plate 20 and is about to be slidingly engaged at the other end of the anchor plate 20. Briefly, the first and second fasteners 12*a*, 12*b* are first secured to the toilet bowl 16 and the anchor plate 20 is then positioned over the second fastener 12*b* such that the second head 18*b* of the second fastener 12*b* falls within the center hollow 34 of the anchor plate 20. The anchor plate 20 is then slid and guided into mating position with the fasteners 12*a*, 12*b*. Removal is achieved by simply disengaging the anchor plate 20 from the fasteners 12*a*, 12*b* and sliding the anchor plate 20 the direction opposite that which it was moved upon installation.

First and second bolts 36*a*, 36*b* together with first and second nuts 38*a*, 38*b* form the first and second fasteners 12*a*, 12*b*, which are secured to the toilet bowl 16 through the conventional bolt holes found in porcelain toilets. As will be better appreciated based upon the following discussion, bolt holes of conventional toilets are generally spaced approximately 5.2 to 5.8 inches apart from center to center.

Each bolt 36*a*, 36*b* includes a head 18*a*, 18*b* and a lower flange 14*a*, 14*b*. The head 18*a*, 18*b* and lower flange 14*a*, 14*b* are spaced from one another by a neck portion 40*a*, 40*b*. The lower flange 14*a*, 14*b* is generally circular and of a diameter greater than the diameter of the holes formed in the toilet bowl.

Figure 4:
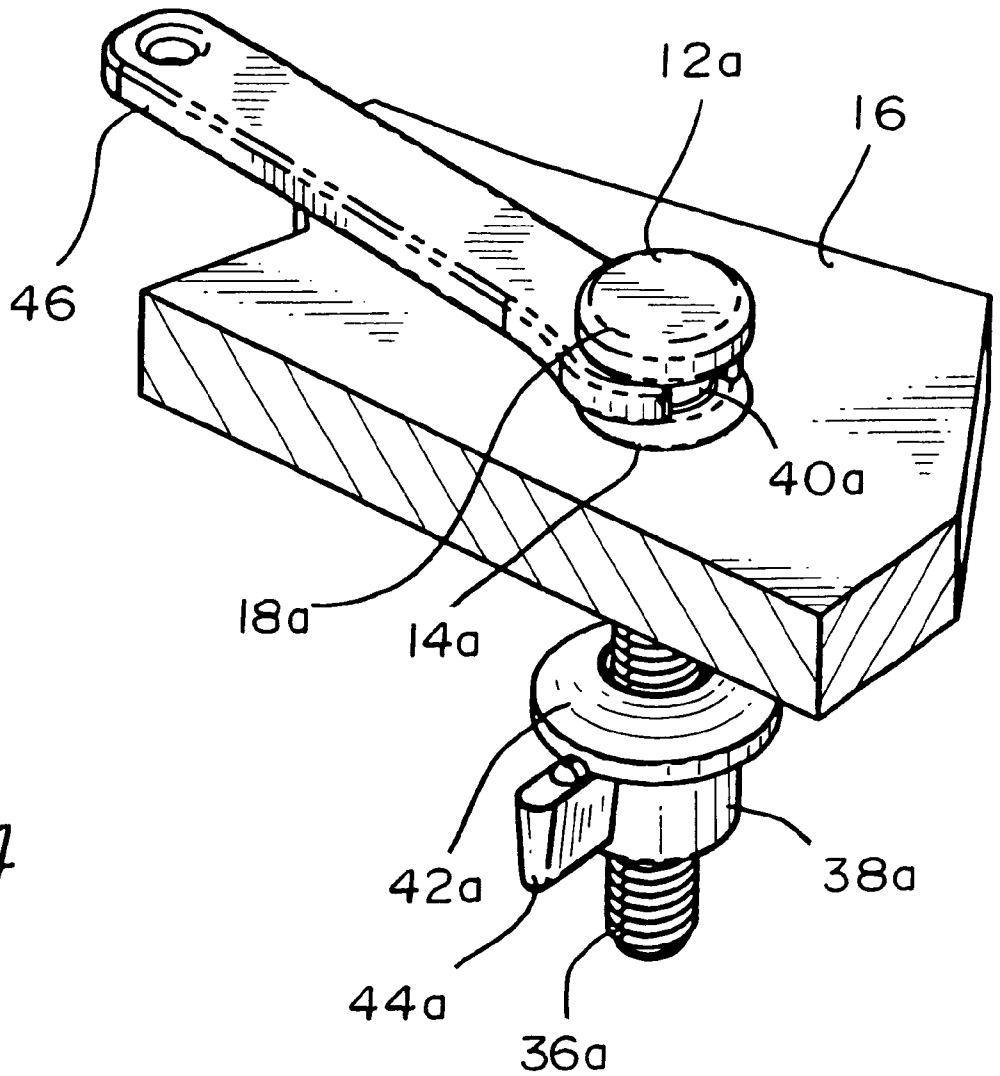
FIG. 4 is an exploded perspective view illustrating the fastener being attached to the top surface (cut-away) of a toilet bowl.

The neck portion 40*a*,40*b* is preferably squared-off. The squared-off neck portion permits a tool 46 as shown in FIG. 4 to engage the bolts 36*a*, 36*b* and prevent them from rotating when a nut 38*a*, 38*b* is being threaded to the bolt 36*a*, 36*b*. Each nut 38*a*, 38*b* has a conical upper surface 42*a*, 42*b* and a wing 44*a*, 44*b*. The conical upper surface 42*a*, 42*b* functions to center the bolt 36*a*, 36*b* in the toilet bowl hole as it moves up the threaded portion. The wing 44*a*, 44*b* allows the nut 38*a*,38*b* to be easily grasp by a user when installing the fastener 12*a*, 12*b*. The tool 46 can be packaged and shipped with the quick release hinge assembly 10 of the present invention. Thus, no additional tools are necessary for installing the present invention.

Figure 5:
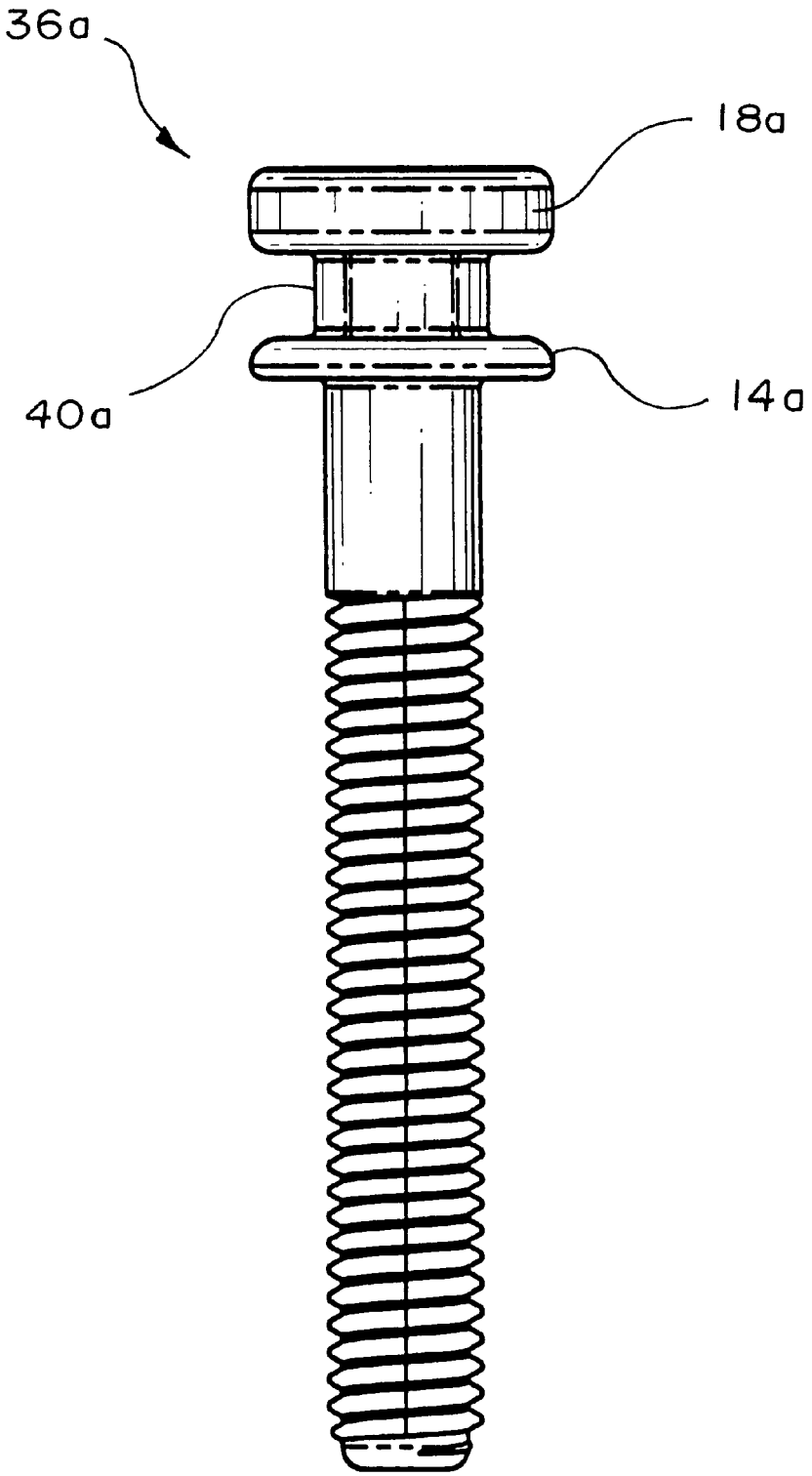
FIG. 5 is a side view illustrating the bolt with its head and lower flange and the squared-off neck therebetween.
Figure 6:
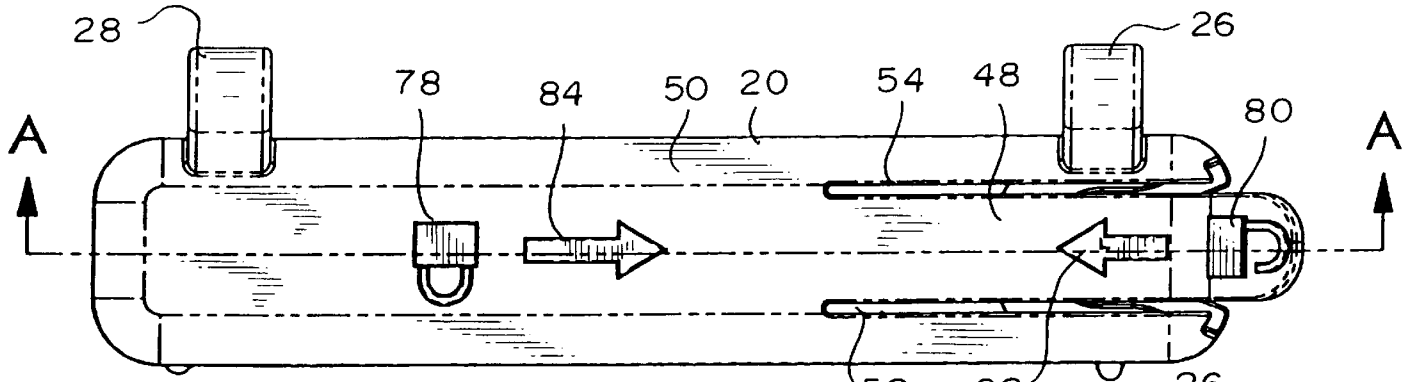
FIG. 6 is a top view of the hinge assembly.
Figure 7:
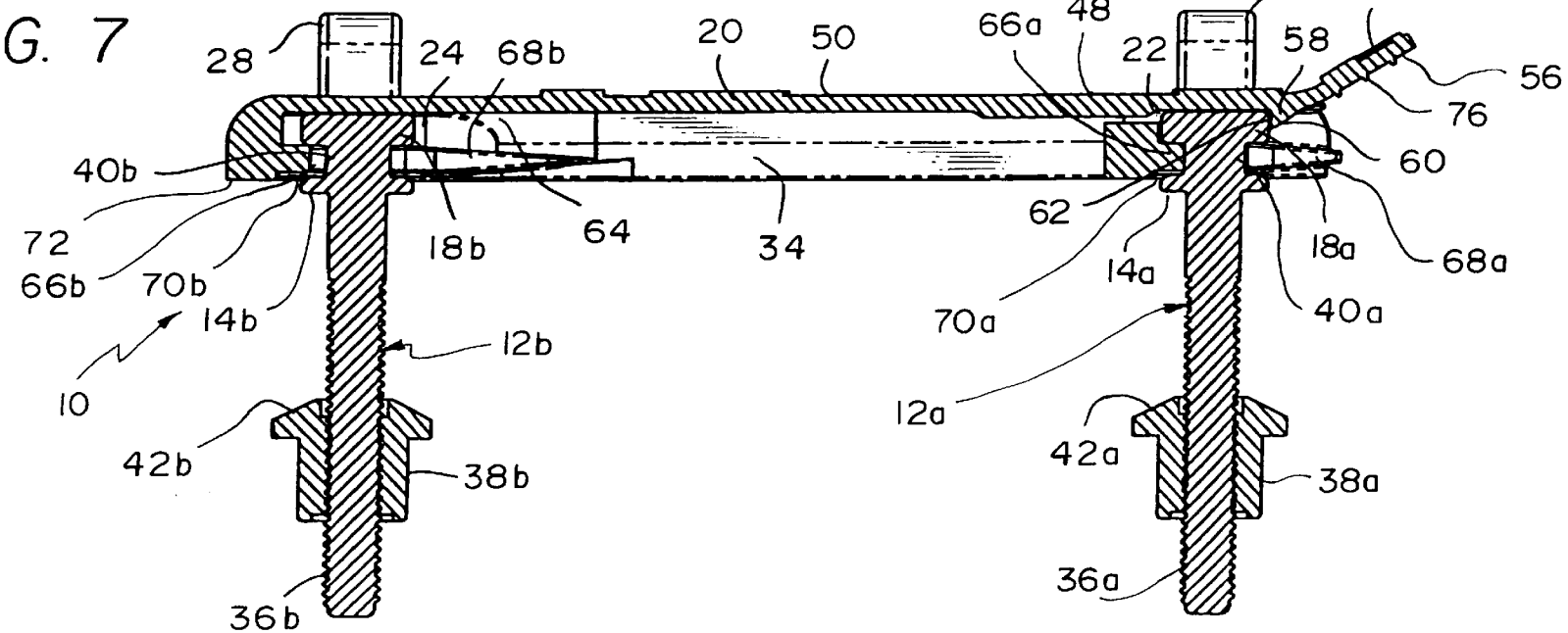
FIG. 7 is a cross sectional view of the hinge assembly shown in FIG. 6 along the line A—A.

FIG. 4 shows an exploded perspective view of the first bolt 36*a* (the second bolt 36*b* is identical) with a wrench 46 fitted onto the squared-off neck portion 40*a* of the bolt 36*a*. The wrench 46 is used to tighten and loosen the bolt 36*a* when installing or removing the bolt through the holes (not visible) in the top surface of the toilet bowl 16. The nut 38*a* enables the user to tighten or loosen the bolt 36*a* by simply inserting the wrench 46 onto the squared-off neck 40*a* of the bolt 36*a* and turning either the nut 38*a* or the wrench 46 while holding the other. FIG. 5 shows a side view of the first bolt 36*a* with a circular head 18*a*, a circular lower flange 14*a* and a squared-off neck portion 40*a* therebetween.

With reference to FIGS. 1, 2, 3 and 7, the anchor plate 20 is provided with first and second neck retaining sections 22, 24 and a resilient latch 48. The first and second neck retaining sections 22, 24 work in conjunction with the resilient latch 48 to securely, but selectively, couple the anchor plate 20 to the underlying fasteners 12*a*, 12*b*.

The latch 48 is formed as a living hinge. The latch 48 is formed in the top surface 50 of the anchor plate 20 by forming first and second slots 52, 54 in the top surface 50 of the anchor plate 20. The slots 52, 54 terminate in holes to reduce stress on the anchor plate 20 as the latch 48 is raised and lowered.

The underside 56 of the latch 48 is provided with a locking assembly 58 shaped and dimensioned to selectively engage the first bolt head 18*a* to securely engage the anchor plate 20 over the first and second bolts 36*a*, 36*b*. The locking assembly 58 includes first and second opposed surfaces 60, 62. The first surface 60 is a rear angled surface allowing the latch 48 to ride up and over the bolt head 18*a* before moving downwardly. Once the bolt head 18*a* has passed under the anchor plate 20 and beyond the rear angled surface 60, the second surface 62, or locking surface, engages the bolt head 18*a* to securely hold the anchor plate 20 in position.

As mentioned above, the underside 64 of the anchor plate 20 is provided with first and second neck retaining sections 22, 24 positioned on opposite ends of the anchor plate 20. Each of the first and second neck retaining sections 22, 24 include a slot 23, 25 which is surrounded by U-shaped lips 66*a*, 66*b* which fit around the neck portion 40*a*, 40*b* of the bolt 36*a*, 36*b* and between the bolt head 18*a*, 18*b* and the lower flange 14*a*, 14*b*. The open end of the U-shaped lips 66*a*, 66*b* are directed at the latch end of the anchor plate 20 in a manner permitting the bolts 36*a*, 36*b* to be respectively slid within the first and second neck retaining sections 22, 24. By properly seating the first and second neck sections 22, 24, in the squared-off necks 40*a*, 40*b* of the bolts 36*a*, 36*b*, the anchor plate 20 is prevented from pulling away from the toilet bowl 16. The first neck retaining section 22 is positioned adjacent the latch 48. This creates a cooperating arrangement wherein the latch 48 and neck retaining section 22 securely hold the first bolt 36*a* relative to the anchor plate 20 to prevent both horizontal and vertical movement. The slot 25 is of a length which permits the lip 66*b* to be retained within neck portion 40*b* when latch 48 is in engagement with first bolt 36*a*. That is, should the distance between bolt head centers vary between 5.2 to 5.8 inches a portion of lip 66*b* will still be retained within the spaced between bolt head 18*b* and flange 14*b*.

More specifically, each of the neck retaining sections 22, 24 of the anchor plate 20 are provided with an angular choke area 68*a*, 68*b*. The angular choke areas 68*a*, 68*b* are shaped to respectively guide the first and second bolts 36*a*, 36*b* into the first and second neck retaining sections 22, 24 where a lip 66*a*, 66*b* encircles the neck portion of each bolt 36*a*, 36*b* between the lower flange 14*a*, 14*b* and the bolt head 18*a*, 18*b*. As mentioned above, the neck retaining sections 22, 24 are configured to accept the bolts 36*a*, 36*b* in a locking relationship. The top and bottom of the anchor plate 20 are spaced from one another by a hollow 34. This hollow 34 defines a space in which the bolts 36*a*, 36*b* may move and further permits the formation of the lips 66*a*, 66*b* between the top surface 50 of the anchor plate 20 and the bottom surface 72 of the anchor plate 20. The thickness of the lips 66*a*, 66*b* substantially corresponds to the neck portion 40*a*, 40*b* spaced between the head 18*a*, 18*b* and lower flange 14*a*, 14*b* of each bolt 36*a*, 36*b*.

The lips 66*a*, 66*b* of the neck retaining sections 22, 24 are recessed from the bottom surface 72 of the anchor plate 20, but could be formed directly in the bottom surface 72 of the anchor plate 20. The recessed areas 70*a*, 70*b* directly beneath the lips 66*a*, 66*b* of the neck retaining sections 22, 24 are generally C-shaped and dimensioned to correspond with the shape of the lower flange 14*a*, 14*b* on the bolt 36*a*, 36*b*.

The bottom surface 72 of the anchor plate 20 is slightly curved as one travels from one end to the other. That is, the bottom surface 72 is slightly bowed with the raised portion being approximate the center. This bowed feature permits the anchor plate 20 to accommodate variations in toilet bowl tops. Since most toilets are poured porcelain, the top of the bowl has slight imperfections and is not always perfectly level. The ends of the bottom surface 72 can be lower since the lower flange 14*a*, 14*b*, which rests upon the upper surface of the toilet bowl 16, will prevent the bottom surface 72 of the anchor plate 20 from contacting the toilet bowl regardless of imperfections.

Figure 2:
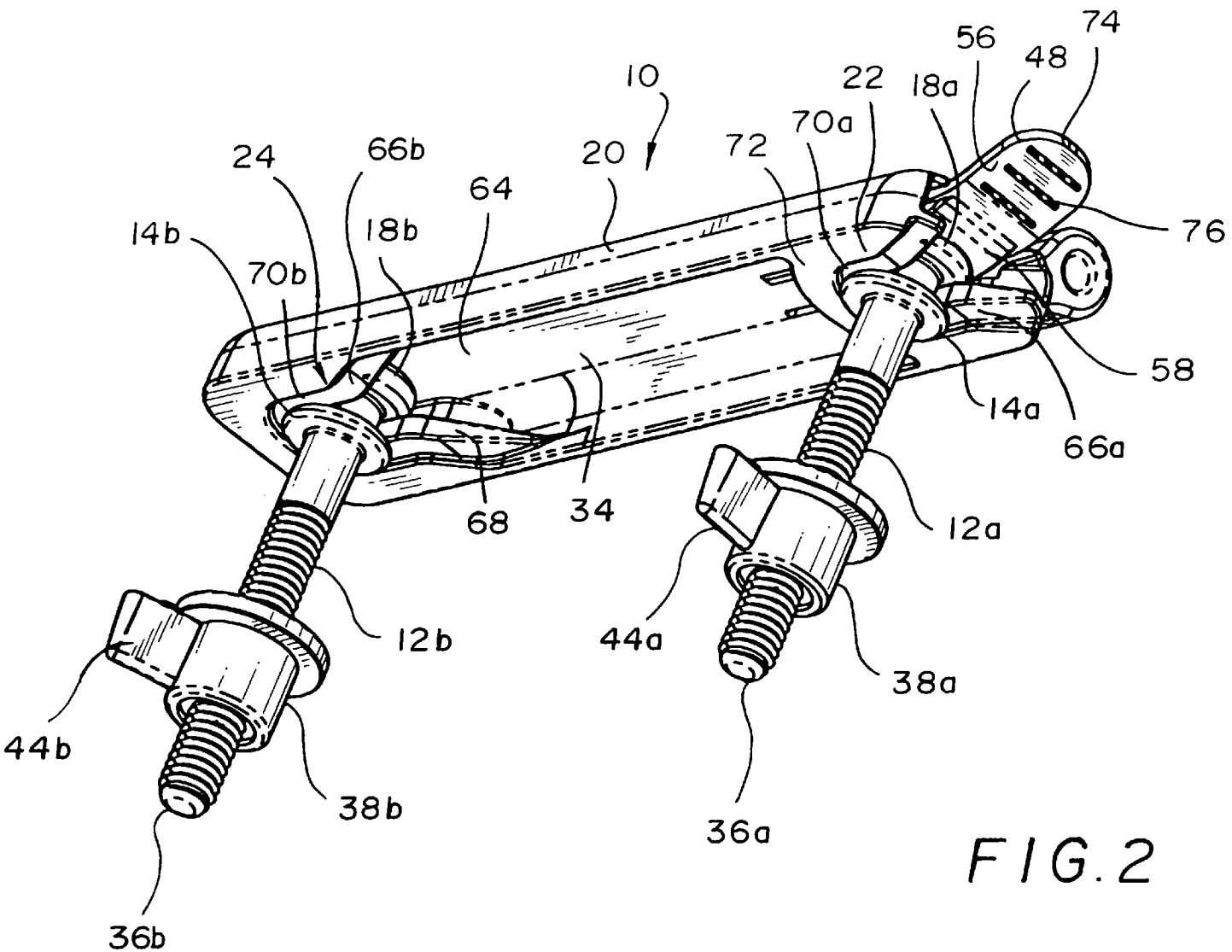
FIG. 2 is an exploded perspective view from the bottom illustrating the anchor plate secured to the toilet bowl (cut-away) via fasteners.
Figure 3:
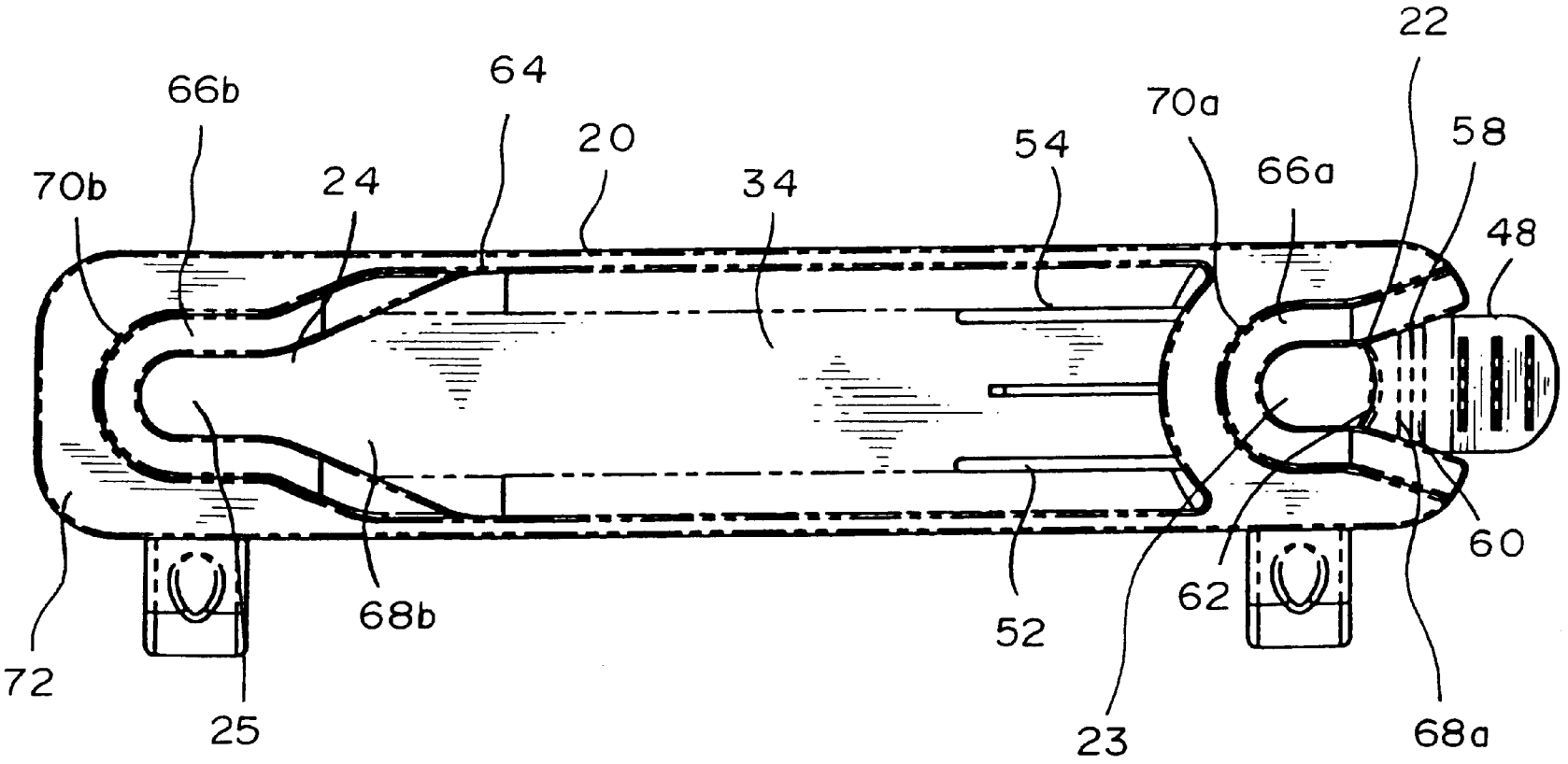
FIG. 3 is a bottom plan view illustrating the one-piece anchor plate including the anchor plate slots and the angular slot choke areas.

The latch 48 further includes a raised tab 74 which as shown in FIG. 2. The raised tab 74 includes ridges 76 which add some degree of texturing to the underside 56 of the latch 48 to allow for easy operation via a user's finger. Although ridges are shown, it is contemplated that this texturing could occur in many forms, such as dimpling, serrating, etc. The anchor plate 20 is further provided with self-explanatory indicia 78,80, 82, 84 which function as instructional markings on the top surface 50 of the anchor plate 20. These aid in helping the user quickly understand how to lock and unlock the anchor plate 20 to and from the bolts 36*a*, 36*b*. The indicia include a locked pad lock indicia 78 with a locking arrow indicia 84 to show the direction one slides the anchor plate 20 to lock the toilet seat 16 in place and an unlocked pad lock indicia 80 with an unlocking arrow indicia 82 to show the direction an anchor plate 20 needs to move to remove the toilet seat 30 from the toilet bowl 16 extending from the anchor plate 20 are a pair of spaced hinge mounting supports 26, 28 which can be integrally formed therewith. A toilet seat 30 (cut-away) with a hinge section and a toilet seat lid 32 (cut-away) with a hinge section are pivotally coupled via a hinge pin 86 to the mounting supports 28. Once pivotally coupled to the toilet seat 30, the lid 32 and the anchor plate 20 form a unit that can be slid on and off of the bolts 36*a*, 36*b* extending upwardly from the toilet bowl 16.

To install the present hinge assembly 10, the first and second fasteners 12*a*, 12*b* are first secured to the toilet bowl 16 via the conventional holes formed therein. When in place, the lower flange 14*a*, 14*b* of each bolt 36*a*, 36*b* rests on top of the bowl surface since its diameter is too large to pass through the hole. The heads 18*a*, 18*b* extend above the surface. The fasteners 12*a*, 12*b* are secured by passing a bolt 36*a*, 36*b* through the bowl hole and then treading a nut 38*a*,38*b* thereon. As the nut 38*a*, 38*b* travels up the threaded portion, its conical upper surface 42*a*, 42*b* will travel into the hole and center the bolt 36*a*, 36*b* therein.

The anchor plate 20 is next positioned over the second bolt 36*b* such that the head 18*b* falls within the center hollow 34 of the anchor plate 20. The anchor plate 20 is then slid in the direction of the arrow 84 and guided into mating position with the squared-off neck sections 40*a*, 40*b* entering the lips 66*a*, 66*b*. As the anchor plate 20 continues to move in the direction of the arrow 84, the angular chokes 68*a*, 68*b* funnel the bolt 36*a*, 36*b* into the neck retaining sections 22, 24. The latch 48, due to its resiliency and the angle on the locking mechanism 58 travels up and over the first bolt head 18*a* and then is resiliently biased downward such that the locking surface 62 of the locking assembly 58 engages the bolt head 18*a* to prevent movement in the direction of the arrow 82. Since the lips 66*a*, 66*b* of the neck retaining sections 22, 24 now respectively reside in the space between the heads 18*a*, 18*b* and the flanges 14*a*, 14*b*, the anchor plate 20 cannot be lifted up off the bowl 16. Further, and due to the length of retaining sections 22, 24 defined by the lips 66*a*, 66*b*, bolt heads 18*a*, 18*b* which are spaced anywhere from 5 to 5.10 inches apart can still have a portion of lips 66*a*, 66*b* reside in the squared-off neck portion 40*a*, 40*b* and be locked in place.

To remove the anchor plate 20 all one needs to do is engage the tab 74, raise the latch 48 until the locking assembly 58 clears the first bolt head 18*a* and then slide the anchor plate 20 in the direction of the arrow 82 located on the latch portion 48 of the anchor plate 20.

The lower flange 14*a*, 14*b* is not only dimensioned to fit within the recess 70*a*, 70*b* but is dimensioned to prevent the bottom surface 72 from contacting the surface of the toilet bowl 16. This is necessary to accommodate for imperfect bowl surfaces, but also to create an air gap under the anchor plate. This prevents moisture from accumulating and allows air circulation to promote evaporation.

The present invention provides a quick release hinge assembly whose operation is easy to understand by users young and old. The hinge assembly employs a pull-up lever accompanied by self-explanatory indicia depicting an opened and closed lock with appropriate arrows pointing in the appropriate directions for proper operation. The hinge assembly is preferably sold in the form of a kit with an anchor plate, a pair of fasteners and a plastic wrench packaged together with an instruction sheet.

The present hinge assembly further promotes cleanliness, and therefore, enables the user to easily clean a toilet. After the toilet seat is removed, the only hardware left on the toilet bowl are two smooth, flat knobs or disks forming the top surface of the bolt heads. There are no notches or slots that are difficult to clean in and around. The back side of the toilet bowl and the area around the bolts are left completely accessible.

The quick release hinge assembly also permits more flexibility in mounting toilet seats and lids on toilets whose bolt-receiving holes are not spaced apart according to standard measurements. The present invention has tolerances that allow for 5.2 to 5.8 inch centers. The "bolt-receiving" slots on the underside of the anchor plate are designed to provide a quick release function for virtually every toilet seat and lid connection.

The hinge assembly reduces the accumulation of moisture on the top of the toilet bowl surface while the toilet seat is installed. The present invention, when installed, is constructed so that the hinge itself does not rest directly on the top surface of the toilet bowl. Rather, the anchor plate locks onto a squared-off area between the heads and lower flanges of the bolts. The bottom flange acts as a washer and rests directly on the toilet bowl. This provides an air space between the toilet bowl and the anchor plate permitting evaporation and accumulation of moisture. This reduces possible damage or deterioration to the parts, reduces odor and enhances cleanliness.

While a particular preferred embodiment has been shown and described, it is understood that there is no intent to limit the invention by such disclosure, but rather it is intended to cover all modifications and alternate constructions falling within the spirit and scope of the invention as defined in the appended claims.

What is claimed is:

1. A quick release hinge assembly for a toilet seat comprising:

a pair of fasteners each having a flange for engaging a toilet bowl when attached thereto and a head spaced above the flange;

an anchor plate having an upper surface, an under surface and a pair of lips formed on the under surface and extending below thereof which cooperate with said pair of fasteners to secure the anchor plate to the fasteners;

at least one resiliently biased latch formed on the upper surface of the anchor plate for locking and unlocking said anchor plate to at least one of said fasteners; and said anchor plate further including a hinge mounting support extending therefrom to which a toilet seat and lid pivotally coupled.

2. The quick release hinge assembly of claim 1, wherein said anchor plate upper surface is located above and covers the heads of said fasteners and the anchor plate further includes sides which extend down from the upper surface to enclose the fasteners when the anchor plate is installed.

3. The quick release hinge assembly of claim 2, wherein said at least one resiliently biased latch is formed in the upper surface of said anchor plate and locks to the head of at least one of said fasteners.

4. The quick release hinge assembly of claim 3, wherein said fastener head which cooperates with the latch is secured between the latch and the lip.

5. The quick release hinge assembly of claim 2, wherein said at least one resiliently latch is a living hinge formed in the upper surface of said anchor plate.

6. The quick release hinge assembly of claim 2, wherein said anchor plate includes three sides extending down from the upper surface thereof and is open on one side and the bottom thereof.

7. The quick release hinge assembly of claim 6, wherein said at least one resilient latch is located in the upper surface of the anchor plate approximate the open side thereof.

8. The quick release hinge assembly of claim 1, wherein said lips slide in between the flange and head of corresponding fasteners.

9. The quick release hinge assembly of claim 1, wherein said lips are U-shaped and include an angled choke area.

10. The quick release hinge assembly of claim 1, wherein said hinge mounting support includes a spaced pair and are integrally formed with said anchor plate.

11. The quick release hinge assembly of claim 10, wherein said hinge mounting supports are integrally formed with said anchor plate.

12. The quick release hinge assembly of claim 1, wherein said anchor plate has a bottom surface which is slightly curved to compensate for imperfections created during the manufacturing of a toilet bowl.

13. The quick release hinge assembly of claim 1, further including a toilet seat and lid mounted to said hinge mounting support.

14. The quick release hinge assembly of claim 1, wherein said pair of fasteners are thread and each include a threaded nut with an angular top surface which mates with the underside of a toilet bowl.

15. The quick release hinge assembly of claim 1, wherein said entire assembly is made form a plastic.

16. The quick release hinge assembly of claim 1, wherein the pair of lips permit secure attachment to bolts spaced anywhere between 5.2 to 5.8 inches apart.

17. A toilet seat mounting kit comprising:

a pair of thread bolts with a flange spaced below a head thereof;

a pair of nuts which cooperate with the bolts; and an anchor plate having an upper surface, an under surface and a pair of lips formed on the under surface and extending below thereof which cooperate with said pair of thread bolts to secure the anchor plate to the bolts;

a least one resiliently biased latch formed on the upper surface of the anchor plate for locking and unlocking said anchor plate to at least one of the bolts;

said anchor plate further including a hinge mounting support extending therefrom to which a toilet seat and lid are adapted to be pivotally coupled;

a wrench dimensioned to fit within the space between the head and flange of each bolt.

18. The toilet seat mounting kit of claim 17, further including a toilet set and lid pivotally secured to said pair of hinge mounting supports.

19. The toilet seat mounting kit of claim 17, further including a set of instructions explaining how to install and operate the toilet seat to a conventional toilet bowl.

20. A quick release hinge, toilet seat and lid assembly comprising:

a pair of fasteners each having a flange for engaging a toilet bowl when attached thereto and a head spaced above the flange;

an anchor plate having an upper surface, an under surface and a pair of lips formed on the under surface and extending below thereof which cooperate with said pair of fasteners to secure the anchor plate to the fasteners;

at least one resiliently biased latch formed on the upper surface of the anchor plate for locking and unlocking said anchor plate to at least one of said fasteners; and said anchor plate further including a hinge mounting support extending therefrom to which said toilet seat and lid are pivotally coupled via a hinge pin.

* * * * *